US007059600B2

(12) United States Patent
Jarimba

(10) Patent No.: US 7,059,600 B2
(45) Date of Patent: Jun. 13, 2006

(54) KIT AND METHOD FOR PLAYING A GOLF AND SOCCER-LIKE GAME

(76) Inventor: Jose A. Jarimba, 1530 W. Hall Acres Rd., Pharr, TX (US) 78577

( * ) Notice: Subject to any disclaimer, the term of this patent is extended or adjusted under 35 U.S.C. 154(b) by 0 days.

(21) Appl. No.: 10/700,762

(22) Filed: Nov. 4, 2003

(65) Prior Publication Data

US 2005/0093226 A1 May 5, 2005

(51) Int. Cl.
*A63B 67/14* (2006.01)
*A63B 37/12* (2006.01)
*A63B 39/06* (2006.01)

(52) U.S. Cl. ..... 273/108.2; 273/343; 473/573

(58) Field of Classification Search ..... 473/324–350, 473/409, 573, 52, 33, 131, 165, 280, 248, 473/247, 246; 273/108.2, 108.5, DIG. 30, 273/343, 348.4
See application file for complete search history.

(56) References Cited

U.S. PATENT DOCUMENTS 278,341 A * 5/1883 Kelly ..... 473/3
569,438 A * 10/1896 Urquhart ..... 473/245
1,150,517 A * 8/1915 Hawk ..... 473/3
1,399,864 A * 12/1921 Johnson ..... 473/3
3,715,123 A * 2/1973 Baum ..... 473/159
3,829,092 A * 8/1974 Arkin ..... 473/288
3,876,210 A 4/1975 Brandell
3,913,915 A 10/1975 Carmen
4,017,076 A * 4/1977 Bai ..... 273/348.4
4,026,561 A 5/1977 Baldorossi et al.
4,229,004 A * 10/1980 Stokes ..... 473/3
4,244,576 A * 1/1981 Mosier et al. ..... 473/159
4,575,078 A * 3/1986 Fogarty et al. ..... 473/32
4,799,666 A * 1/1989 Obligio ..... 472/66
4,957,290 A 9/1990 Major et al.
5,344,155 A * 9/1994 Huang ..... 273/348.4
5,364,103 A 11/1994 Chen et al.
5,383,665 A * 1/1995 Schultz et al. ..... 473/159
5,928,087 A * 7/1999 Emberton et al. ..... 473/245
6,217,458 B1 4/2001 Armstrong, III et al.

* cited by examiner

*Primary Examiner*—Eugene Kim
*Assistant Examiner*—Alvin A. Hunter, Jr.
(74) *Attorney, Agent, or Firm*—Dale J. Ream

(57) ABSTRACT

A kit and method for playing a golf and soccer-like game includes a kit having at least one play ball and a target ball. The kit includes a club having a shaft with a club head rotatably coupled to the shaft. The club head includes a symmetrical club face portion that usable by right or left handed players and may be rotated to adjust the pitch angle of the club face. The shaft of the club is telescopically adjustable. The target ball may be kicked to begin the game. The play ball is smaller than the target ball and may be struck repeatedly with the club until it strikes the target ball. Multiple players using different play balls may take turns striking their ball toward the target ball. Points are awarded for the fewest strokes or for location on the target ball that is hit.

3 Claims, 6 Drawing Sheets

KIT AND METHOD FOR PLAYING A GOLF AND SOCCER-LIKE GAME

BACKGROUND OF THE INVENTION

This invention relates generally to sports equipment and related games and, more particularly, to a kit and method for playing a golf and soccer-like game.

It is enjoyable for a family or for friends of various ages to get together and play games. However, many outdoor sports and games require equipment specific to the size of the participant or require expensive combinations of equipment, e.g. a full set of golf clubs and accessories.

While existing sports games and equipment provide enjoyment to its participants, they do not provide an inexpensive combination of balls and equipment in which the same equipment pieces may be utilized by all participants of various ages and sizes while providing for a variety of shots. Further, it is desirable to have a kit and method for playing a game in which a club includes an adjustable shaft length and in which a club head is rotatably adjustable to vary the pitch angle of a shot.

SUMMARY OF THE INVENTION

A kit and method according to the present invention includes a club, a target ball, and a plurality of play balls. The target ball is similar in size to a soccer ball and may be initially kicked away from the players and club to begin the game. The object of the game is for a player to strike his respective play ball until it impacts against the target ball. The player who strikes his play ball the fewest number of times to hit the target ball is the winner. Players may take turns striking their respective balls. The club includes several elements of adjustability to make it usable by players of various heights and for striking the play ball into the air at selectable pitch angles. More particularly, the club shaft is telescopically extensible for use by both short and tall players. And the club head is selectively rotatable such that the pitch angle of the club face may be selectively angled for selective loft. The club head also includes a symmetric configuration for use by both left and right handed players.

Therefore, it is desirable to have a kit and method of play that allows family and friends at various age and size levels to enjoy game play.

Another object of this invention is to have a kit and method, as aforesaid, that provides play of a golf and soccer-like game.

Still another object of this invention is to have a kit and method, as aforesaid, having a club that is telescopically adjustable to be used by players of various heights.

Yet another object of this invention is to have a kit and method, as aforesaid, including a club with a rotatably adjustable club head for hitting shots at selected pitch angles.

A further object of this invention is to have a kit and method, as aforesaid, having a club that allows a player to manually release a club head to be rotated or to fix the club head at a selected configuration.

A still further object of this invention is to have a kit and method, as aforesaid, in which multiple players may strike a respective play ball until it impacts a target ball.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A kit 10 and method 100 for playing a golf and soccer-like game is described in detail with reference to FIGS. 1 to 5*c* of the accompanying drawings.

Figure 1:
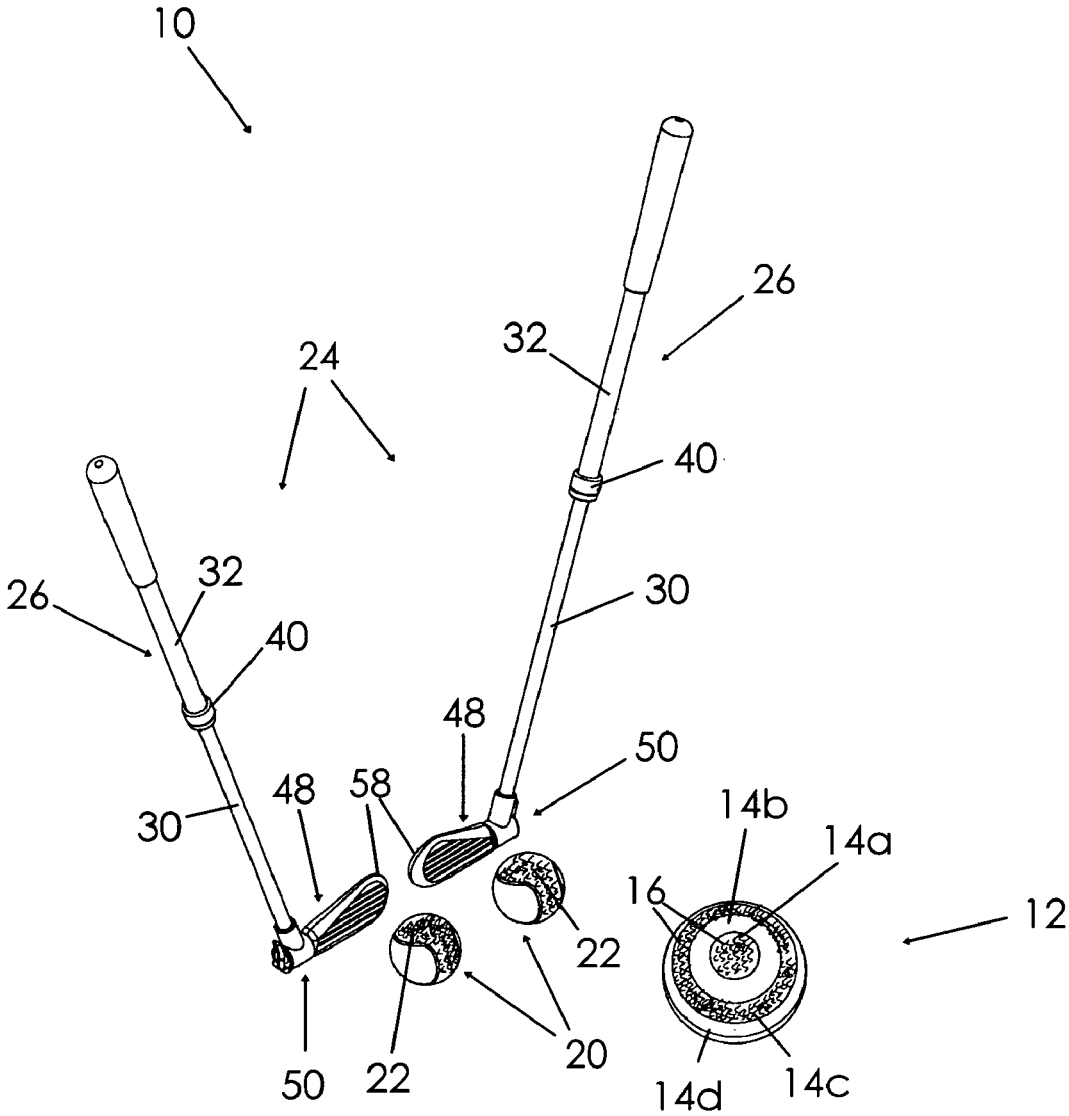
FIG. 1 is a perspective view of a kit for playing a golf and soccer-like game according to a preferred embodiment of the present invention.

As shown in FIG. 1, the kit 10 includes a club 24, a target ball 12, and at least one play ball 20. While one play ball 20 is suitable for single player game play, it is preferred to have a plurality of play balls 20 with each play ball being different than the others, e.g. different colors. The target ball 12 and each play ball 20 present a conventional spherical configuration. Further, the target ball 12 includes a plurality of concentric regions shown as 14*a* to 14*d* in FIG. 1. Each concentric region is associated with a predetermined point value and respective point values may be imprinted thereon with appropriated indicia or color/pattern variations (not shown).

Each play ball 20 is preferably slightly heavier than a tennis ball and includes a weight of about 2¼ ounces and presents a diameter of about 2⅝ inches. Each play ball 20 further includes a layer of fuzzy material for improving the "feel" of a shot when impacted by the club head, as to be described in greater detail below. The target ball 12 includes a diameter that is larger than the play ball diameter, the target ball preferably being about 8⅝ inches in diameter.

The target and play balls 12, 20 may each include respective of hook and loop fastening material 16, 22, respectively, attached to respective outer surfaces such that a play ball 20 may releasably adhere to the target ball 12 upon impact. Therefore, particular points may be scored depending on what concentric region a play ball 20 affixes to.

The kit 10 further includes a club 24 having a shaft 26 and a club head 48 coupled to a first end 28 of the shaft 26. More particularly, the shaft 26 includes a first shaft portion 30 defining a longitudinal axis that is telescopically received in a second shaft portion 32 and movable along the longitudinal axis. The first 30 and second 32 shaft portions, therefore, are length adjustable to multiple configurations (FIG. 2*a* to 2*c*).

Figure 4A:
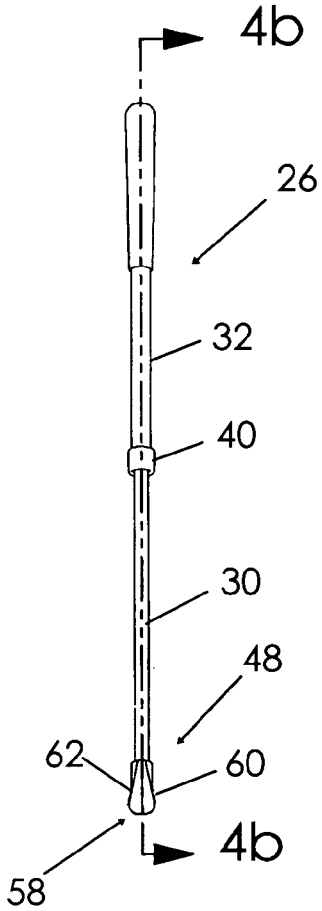
FIG. 4*a* is a front view of the club as in FIG. 2*b;*
Figure 4B:
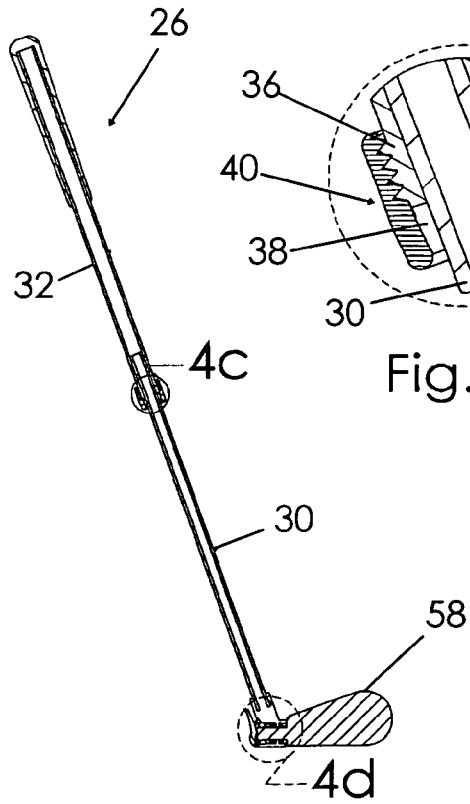
FIG. 4*b* is a sectional view of the club taken along line 4*b*–4*b* of FIG. 4*a;*
Figure 4C:
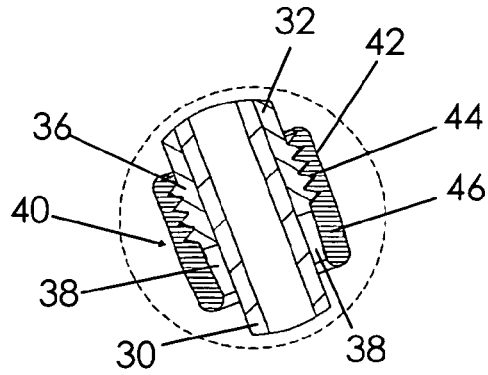
FIG. 4*c* is a sectional view on an enlarged scale of a respective section of FIG. 4*b;*

A threaded coupling 40 regulates when the first shaft portion 30 is received into or removed from the second shaft portion 32 (FIGS. 4*a* to 4*c*). More particularly, a plurality of threads 36 are formed on the second shaft portion 32 adjacent a lower end 34 thereof (FIG. 2*c*). A flange or plurality of flanges 38 are connected to the second shaft portion 32 intermediate the threads 44 and lower end 34. The coupling 40 includes an upper cylindrical section 42 having a plurality of threads 44 complementary to the threads 36 on the second shaft portion 32 (FIG. 4*c*). The coupling 40 includes a tapered section 46 depending from the cylindrical section 42. As the threads 44, 36 of the coupling 40 and second shaft portion 32, respectively, are engaged and tightened, the tapered section 46 is frictionally tightened relative to the flanges 38. Accordingly, the first and second shaft portions are telescopically adjustable when the coupling 40 is loosened and are fixed in position when the coupling 40 is tightened.

Figure 2A:
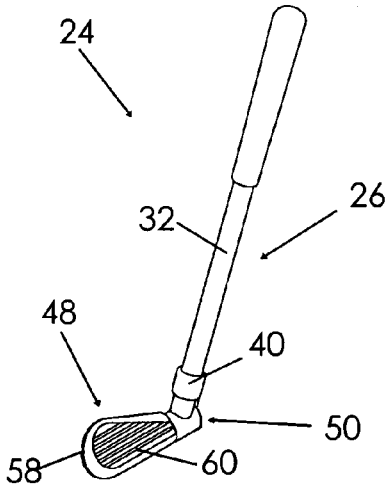
FIGS. 2*a* and 2*b* are perspective views of the club shown in FIG. 1 in respective telescopic configurations.
Figure 2B:
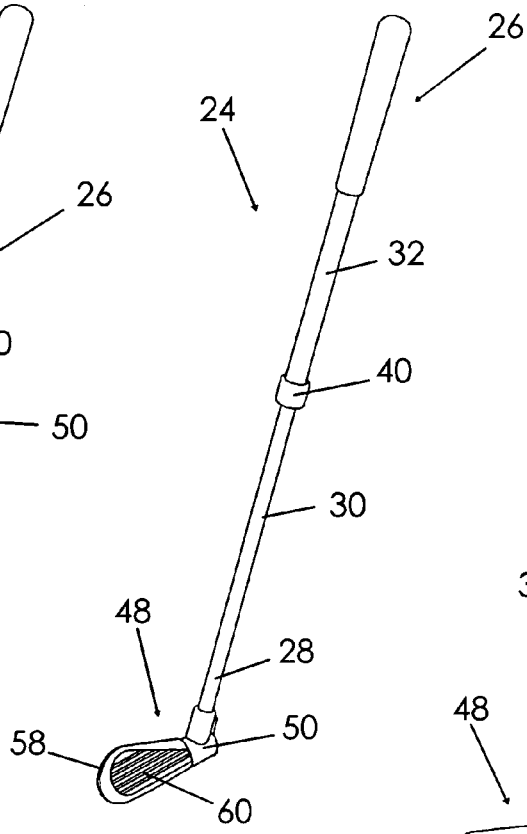
Figure 2C:
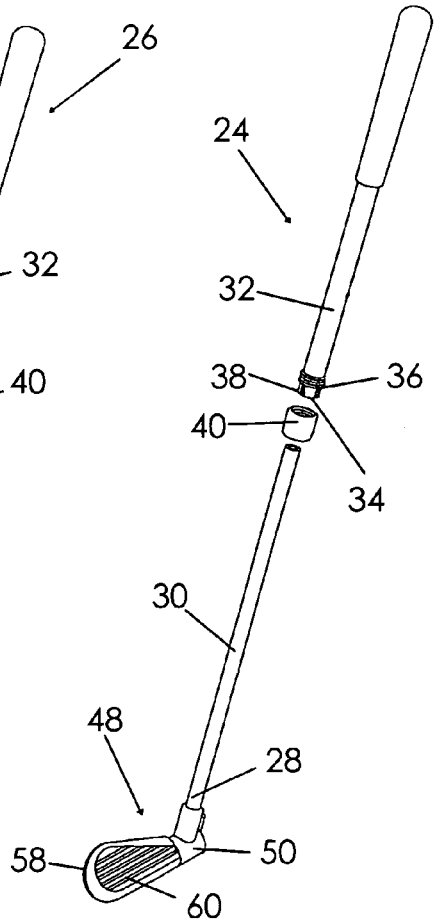
FIG. 2*c* is an exploded view of the club as in FIG. 2*b;*
Figure 3:
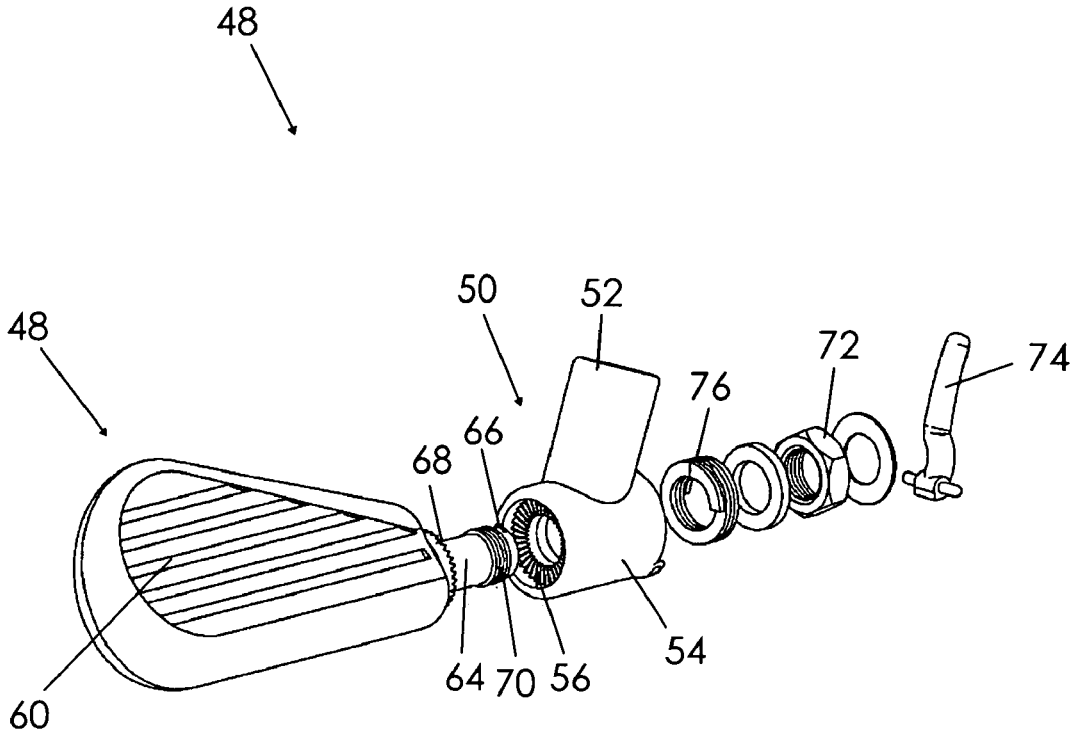
FIG. 3 is an exploded view of a hosel and club head of the club shown in FIG. 2*a;*

A club 24 includes a hosel 50 for interconnecting the club head 48 to the first end 28 of the shaft 26 (FIG. 2*a*). The hosel 50 includes an upper portion 52 having a cylindrical configuration for receiving the first end 28 of the shaft 26 therein, the upper portion 52 being inline with the longitudinal axis defined by the shaft 26. The hosel 50 further includes a lower portion 54 having a cylindrical configuration and defining a bore therethrough, the lower portion 54 and bore being arranged at an acute angle relative to the upper portion 52 (FIG. 3). A hosel spline 56 is positioned within the bore. The club head 48 is coupled to the hosel 50 for adjustable operation as to be described more fully below.

The club head 48 includes a club face portion 58 having first 60 and second 62 club faces arranged in a symmetrical configuration (FIG. 4*a*). More particularly, each club face has an identical configuration so that the club 24 may be used by right or left handed players to strike a play ball 20. The angle of each club face determines the pitch angle of a ball struck thereby. An attachment rod 64 is fixedly attached to and extends outwardly from one side of the club face portion 58 and terminates at a free end 66 (FIG. 3). A club head spline 68 extends about said rod 64 adjacent the club face portion 58. The rod 64 is received by the hosel lower portion bore and is capable of relative longitudinal movement therein, as will be further described below. The rod 64 is held within the hosel bore by threaded engagement of a threaded section 70 of the rod 64 with a nut 72 (FIG. 3).

Figure 4D:
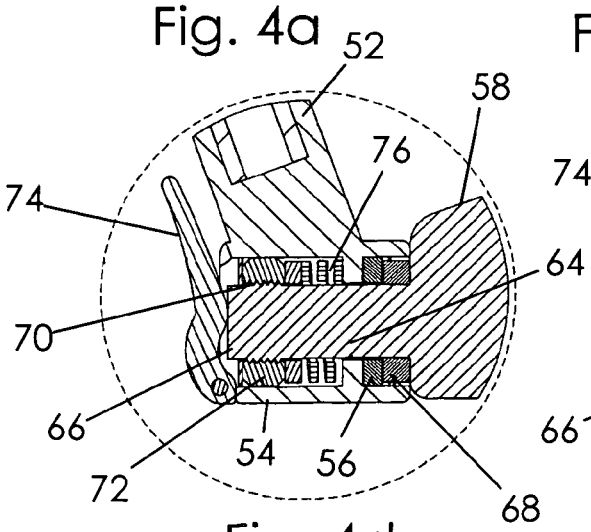
FIG. 4*d* is a sectional view on an enlarged scale of a respective section of FIG. 4*b* in an engaged configuration.
Figure 4E:
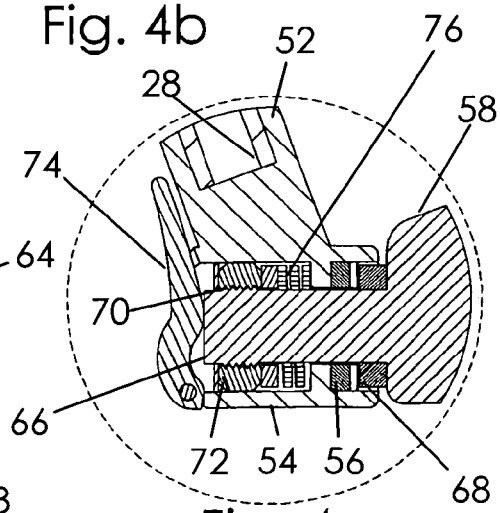
FIG. 4*e* is a sectional view on an enlarged scale of a respective section of FIG. 4*b* in a released configuration.
Figures 5A, 5B, 5C, 5D:
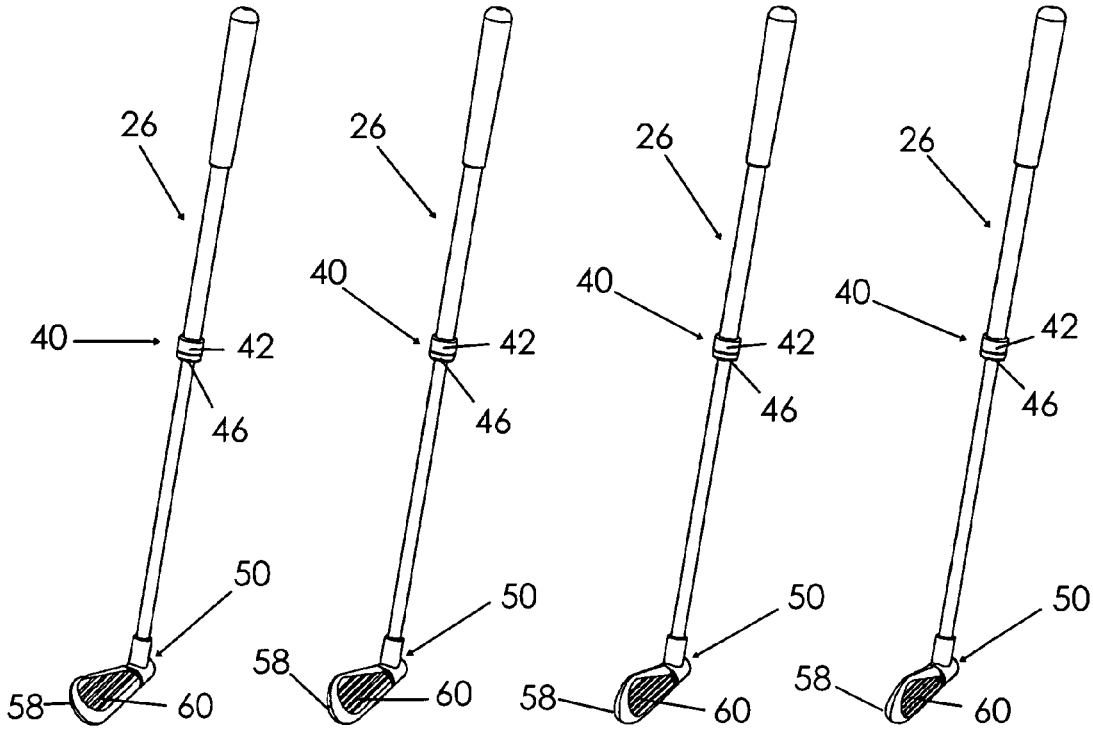
FIGS. 5*a*–5*c* are perspective views of the club as shown in FIG. 2*b* in respective club head pitch configurations.

As shown in FIG. 4*d*, the rod 64 is normally situated in the hosel bore with the club head spline 68 mated with the hosel spline 56 such that the rod 64 and club face portion 58 are prevented from axially rotating (the "engaged configuration"). A lever 74 is pivotally coupled to the hosel lower portion 54 adjacent the bore opening opposite the hosel spline 56 and club face portion 58 (FIG. 3). As shown in FIG. 4*e*, the lever 74 includes a configuration such that an operation thereof causes the lever 74 to bear against the free end 66 of the rod 64 and to urge the rod 64 longitudinally within the bore so as to disengage the club head and hosel splines 68, 56 (the "released configuration"). When the splines are released, the rod 64 and club face portion 58 are free to be axially rotated to adjust the pitch angle of the club face portion 58.

A compression spring 76 is positioned within the hosel bore between the nut 72 and the hosel spline 56. This spring 76 is compressed when the lever 74 is operated to urge the rod 64 to the released configuration (FIG. 4*e*). Upon a release of the lever 74 by a user, the spring 76 urges the rod 64 to move back to its normally engaged configuration (FIG. 4*d*). Therefore, the club head 48 is biased toward the engaged configuration.

Figure 6:
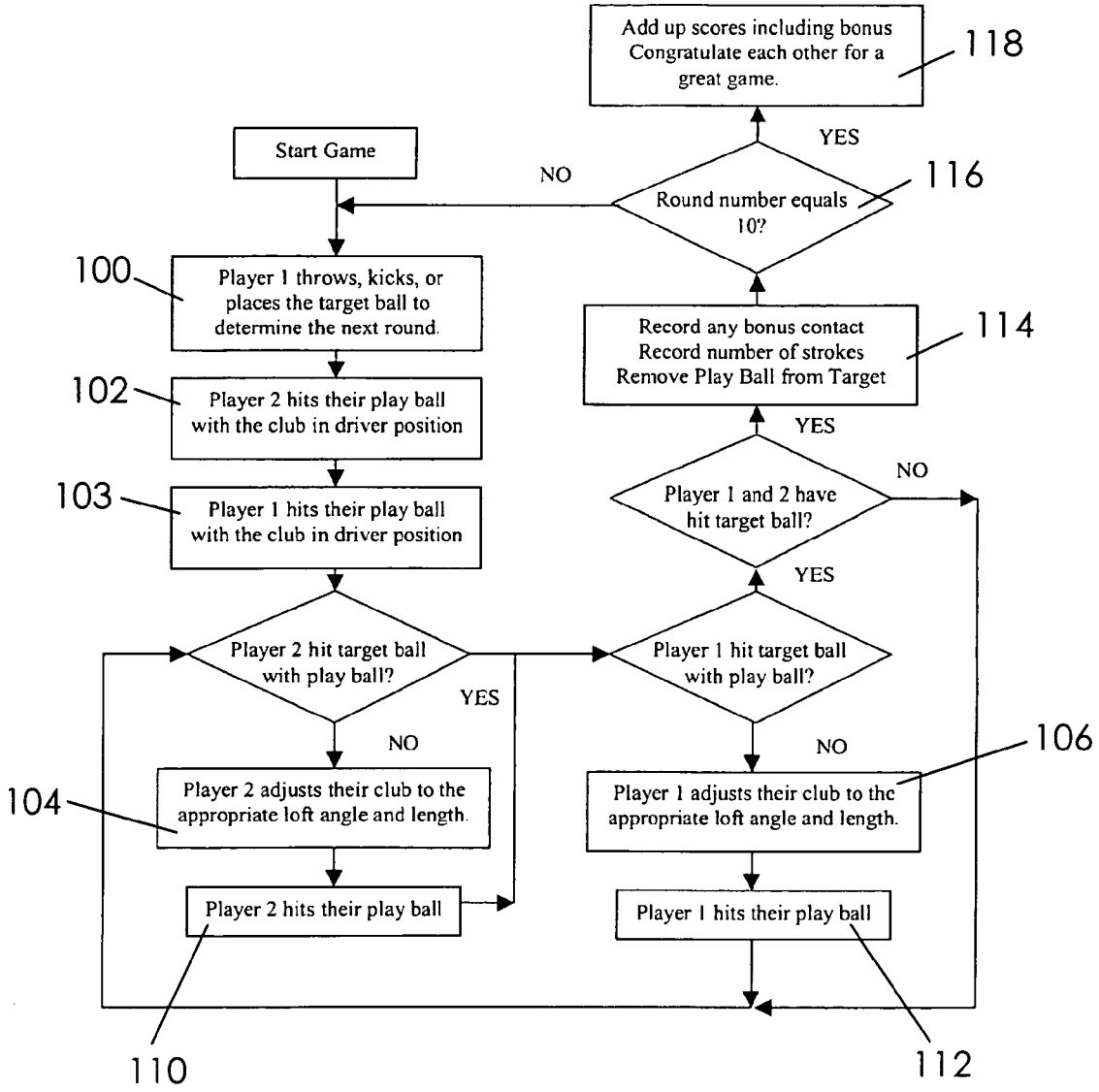
FIG. 6 is a flowchart illustrating a method of game play according to a preferred embodiment of the invention.

The club 24, target ball 12, and plurality of play balls 20 may be used according to a unique method of playing a golf and soccer-like game. More particularly, a first player throws, kicks, or otherwise places the target ball 12 away from the starting location, as indicated by numeral 100 of FIG. 6. The other player may then strike his play ball in an attempt to contact the target ball 12 as indicated at 102. The first player does likewise 103. Players may adjust the pitch angles of their clubs as shown by reference numerals 104 and 106 and may alternately strike their respective play ball as indicated at 110 and 112 until both player's play balls have hit the target ball. At that time, the players may record the appropriate points 114, i.e. depending on the concentric region contacted or where certain hook and loop fasteners were engaged 114. The other player continues on until his play ball 20 strikes the target ball 12. Multiple rounds may be played 116 using this methodology before final scores are tallied 118.

Accordingly, the kit and method described herein is useful to provide enjoyment to players of many sizes and ages, especially to persons who enjoy soccer and golf games.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A method for playing a golf and soccer-like game, comprising (a) providing in combination at least one play ball, a target ball having a generally spherical construction for being kicked in a manner indicative of a soccer-like game and having a plurality of concentric regions wherein each region is associated with a point value, and a club head having a shaft with a club head coupled to the shaft for striking the play ball;

(b) providing at least one player with a club and a play ball;

(c) kicking said target ball a selected distance from said play ball and club to initiate game play;

(d) striking said play ball with said club head of said club for moving said play ball toward said target;

(e) repeating step (d) until play ball strikes said target ball wherein the total point value in combination with the number of strokes of said at least one player determines the winner.

2. The method as in claim 1 wherein:

said target bail has a diameter that is larger than a diameter of said play ball.

3. The method as in claim 1 wherein:

said shaft includes a first shaft portion defining a longitudinal axis and a second shaft portion telescopically received in said first shaft portion and movable along said longitudinal axis, whereby to adjust the length of said shaft; and means on said shaft for selectively holding and releasing said first and second shaft.

* * * * *